US007102119B1

(12) United States Patent
Breslow et al.

(10) Patent No.: US 7,102,119 B1
(45) Date of Patent: Sep. 5, 2006

(54) BALL BOUNCE GAME USING ELECTROMAGNETIC BEAMS

(75) Inventors: Jeffrey D. Breslow, Chicago, IL (US); Zarko Stambolic, Oak Park, IL (US); Karl R. Meyer, South Hadley, MA (US)

(73) Assignee: Hasbro, Inc., Pawtucket, RI (US)

( * ) Notice: Subject to any disclaimer, the term of this patent is extended or adjusted under 35 U.S.C. 154(b) by 78 days.

(21) Appl. No.: 11/064,688

(22) Filed: Feb. 24, 2005

(51) Int. Cl.
*H01J 40/14* (2006.01)
*A63B 37/00* (2006.01)

(52) U.S. Cl. ..... 250/221; 250/222.1; 473/569; 473/570

(58) Field of Classification Search ..... 250/221, 250/222.1; 434/247, 252; 473/569, 570; 273/138.2, 138.3, 138.4, 460
See application file for complete search history.

(56) References Cited

U.S. PATENT DOCUMENTS 4,102,532 A 7/1978 Van Jepmond
4,150,825 A 4/1979 Wilson
4,192,507 A 3/1980 Rains
4,363,484 A 12/1982 Breslow
4,592,554 A 6/1986 Gilbertson
5,145,182 A 9/1992 Swift
5,846,086 A 12/1998 Bizzi

*Primary Examiner*—Georgia Epps
*Assistant Examiner*—Don Williams
(74) *Attorney, Agent, or Firm*—Perry Hoffman

(57) ABSTRACT

The present invention is a computerized game device or game playing method for use with objects such as balls and a generally planar surface. The game device may comprise at least two electromagnetic beam transmitters arranged to emit electromagnetic beams and at least two corresponding electromagnetic beam receivers generating signals. The game device further comprises a support for the transmitters and receivers having a surface shaped to rest stably against the planar surface, the support positioning each transmitter to emit its electromagnetic beam parallel to the other beams and parallel to the planar surface, the support positioning each receiver to receive one of the electromagnetic beams, and the support shaped to permit the objects to pass through the beams and to strike the planar surface without striking the support. The game device further comprises a game computer arranged to receive signals from the receivers and programmed to implement at least one game where performance is judged by analysis of the signals received from the receivers.

20 Claims, 4 Drawing Sheets

BALL BOUNCE GAME USING ELECTROMAGNETIC BEAMS

BACKGROUND OF THE INVENTION

The present invention relates generally to electronic games utilizing balls, and more particularly to such games that detect where a ball bounces by means of sensors when the ball breaks or deflects an electromagnetic beam.

Visible and infrared light beams generated by transmitters and aimed at receivers are well-known as arrangements that can detect when an object or person moves between the transmitter and the receiver, thus blocking the beam from reaching the receiver. For example, elevators have long been equipped with a beam transmitter positioned at one side of an elevator door and beamed at a beam receiver positioned at the other side of the door. The elevator doors are not permitted to close whenever the transmitted beam does not reach the receiver, since it is presumed that some person or object (such as boxes on a dolly) is blocking the elevator door. Similar arrangements are used in conjunction with conveyor belts to detect when boxes and other objects are passing by a work station. Such beams are also used as burglar alarms.

Infrared beams are also used widely in remote controls for television sets and other electronic appliances. In such applications, the beams are normally broader and not so focused, since such remote controls are normally hand held. Since several controllers may be in operation at the same time, the infrared beams generated by remote controls are typically modulated with a different encoding depending upon both the appliance being addressed and also the desired function. Decoders in the television sets and the like decode the information conveyed by the beams first to determine if the information is directed to that particular television set or other appliance and secondly to determine what function is called for.

Infrared beams and visible light beams are also used in conjunction with some touch sensitive computer displays. Horizontal and vertical beams are sent from transmitters to receivers across the surface of such a display to detect any finger that touches the screen and to determine, by which horizontal and which vertical beam is broken, the approximate X and Y coordinates of the finger pressed against the screen.

Electromagnetic transmitters capable of sending beams to electromagnetic receivers have been used in a variety of games and sports activity motion tracking devices in the past. U.S. Pat. No. 5,145,182 discloses a game where the players use mirrors to selectively divert the path of laser beams towards and away from targets. U.S. Pat. No. 5,846,086 discloses a system that uses a stationary electromagnetic wave transmitter with three orthogonally-disposed antennas to detect the motion of a sensor attached, for example, to a ping pong paddle, the sensor having three orthogonally-disposed coils. U.S. Pat. No. 4,592,554 discloses a simulated gun which beams a focused beam of light at a retro-reflective target such that the beam is reflected back to a receiver also mounted on the gun if the gun is properly aimed at the target. U.S. Pat. No. 4,363,484 discloses a simulated ping-pong game where light beams are directed to the fore-hand and back-hand sides of a player, and the player must, within a given short time period, deflect those light beams with a hand-held paddle having a light-diffusing surface such that light is reflected back to a receiver whenever the paddle intercepts the beam. U.S. Pat. No. 4,192,507 discloses a shooting arcade game with multiple simulated guns and multiple targets, each target having a light sensor, each gun having a light pulse transmitter, the system using time multiplexing to determine which gun hit which target. U.S. Pat. No. 4,150,825 discloses two infrared light sources and three linear arrays of focused multiple infrared light sensors. The three linear arrays of multiple sensors, by capturing infrared light reflected off of a driven golf ball, are able to record the left-to-right positioning of the golf ball in three spaced-apart planes oriented generally perpendicular to the golf ball's outward path of travel as it travels away from a golfer and also its return path of travel after it bounces off of a target screen.

SUMMARY OF THE INVENTION

Briefly described, the present invention, in one embodiment, may be a computerized game device or game playing method for use with objects such as balls and a generally planar surface. A game device may comprise at least two electromagnetic beam transmitters arranged to emit electromagnetic beams and at least two corresponding electromagnetic beam receivers generating signals. The game device further comprises a support for the transmitters and receivers having a surface shaped to rest stably against the planar surface, the support positioning each transmitter to emit its electromagnetic beam parallel to the other beams and parallel to the planar surface, the support positioning each receiver to receive one of the electromagnetic beams, and the support shaped to permit the objects to pass through the beams and to strike the planar surface without striking the support. The game device further comprises a game computer arranged to receive signals from the receivers and programmed to implement at least one game where performance is judged by analysis of the signals received from the receivers.

DETAILED DESCRIPTION OF THE EMBODIMENTS

Definition of Terms

Figure 1:
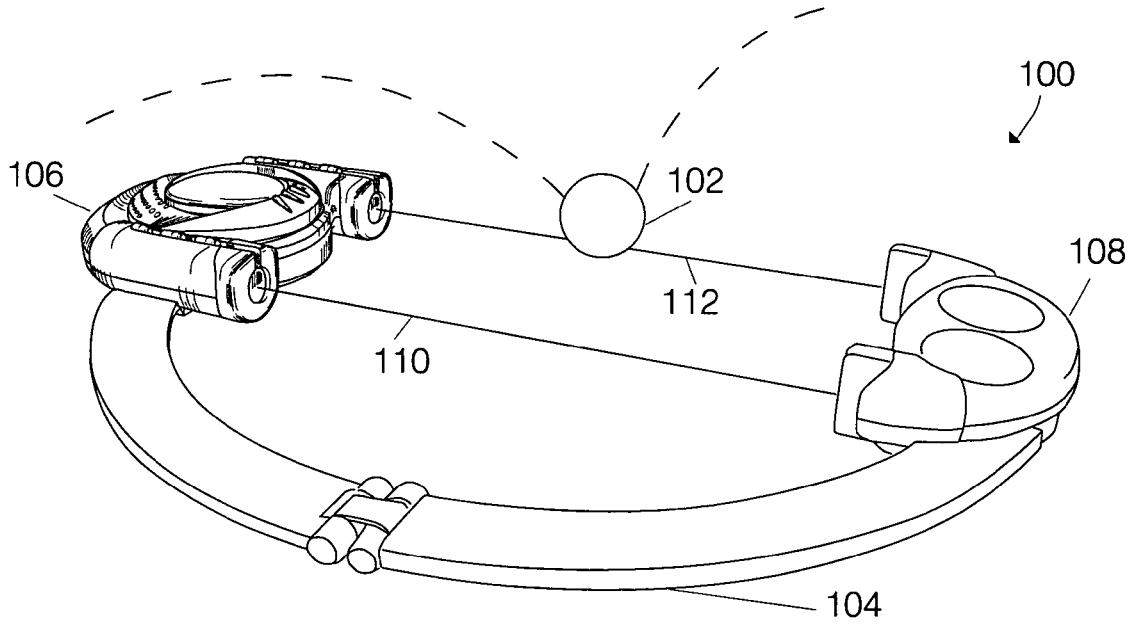
FIG. 1 presents a perspective view of a ball bounce game designed in accordance with an embodiment of the present invention sitting on a flat surface (not shown) and illustrating how a bouncing ball cuts one of two beams and is thereby detected by one of two electromagnetic beam receivers.

The following terms used in this application shall have the respective meanings ascribed to them below unless otherwise expressly defined in this application.

An "electromagnetic beam transmitter" is a device that generates radio waves or visible or infrared or ultraviolet light. In an embodiment of the invention, it is an infrared light emitting diode. It could also be such a diode emitting visible light, and it could be a laser beam of light. It could also be a low power microwave or radio wave beam. The beam may be directional, or it may be encoded or modulated with a beam identification signal, or both.

An "electromagnetic beam receiver" is a device that generates a signal when it receives an electromagnetic beam of the type generated by the electromagnetic beam transmitter. It can be a photodiode that detects visible, infrared, or ultraviolet light or laser light, or it can be some form or microwave or radio receiver. The receiver may be directional, or the receiver (or some downstream component such as a programmed microcontroller) may contain a decoder or demodulator designed to identify a specific beam identification signal, or both.

A "support" is the mechanical assembly that positions the beam transmitters and receivers relative to each other such that the receivers are kept aligned to receive the beams generated by the beam transmitters. The support also maintains the beams parallel to and spaced apart from each other, and it maintains the beams within a plane that is generally parallel to a flat surface upon which, or against which, the support may be placed when the game is played. In an embodiment of the invention, the support is formed from a beam transmitter game unit section containing two beam transmitters and a separate beam receiver game unit section containing two beam receivers interconnected by a removable, foldable connecting arm that maintains the two game unit sections spaced apart in proper alignment and that may also convey electrical signals between the two game unit sections.

A "game computer" is a programmed personal computer, programmed microcomputer, or programmed microcontroller which receives signals from the beam receivers and which then processes those signals in a way that implements one or more bounce ball games. The game computer may be supported by or placed within the "support" as an embedded processor, or it may be remote from the support, receiving signals conveyed by wires or by radio transmissions from the beam receivers.

Introduction

The present invention is an electronic ball bounce game that is arranged to detect how rapidly and accurately one or more balls are bounced in such a manner as to block the path of one or several electromagnetic beams, thereby preventing electromagnetic radiation emitted by beam transmitters from reaching beam receivers. A computer connected to the beam receivers measures the number of bounces that block the beams and how rapidly such bounces occur. The computer is connected to a speaker and is programmed to generate music and speech to teach the game, to indicate the progress of the game, and to proclaim the winner and the winning and losing scores at the end of each game. A number of different games can be implemented with this ball bounce game, as will be explained at a later point.

Mechanical Details

With reference to FIG. 1, an overview of the ball bounce game 100 is shown assembled for play, Normally, the ball bounce game is positioned on a floor or other flat surface such as a table (not shown), but it can also be positioned against a reclining or vertical wall or other flat surface or even against a ceiling. If there is only one player and the game is on a floor or table, the game may also be positioned adjacent a wall or vertical (or angled) partition such that the ball may be bounced first off the floor or table, then off the wall or partition, and then return to the one player. If there are two players, they may position themselves on opposite sides of the game, and a single ball may be bounced off the floor or table from one player to the other and back again. If there are four players, two balls may be bounced back and forth between each pair of two players positioned on opposite sides of the game and working together as a team.

Figure 6:
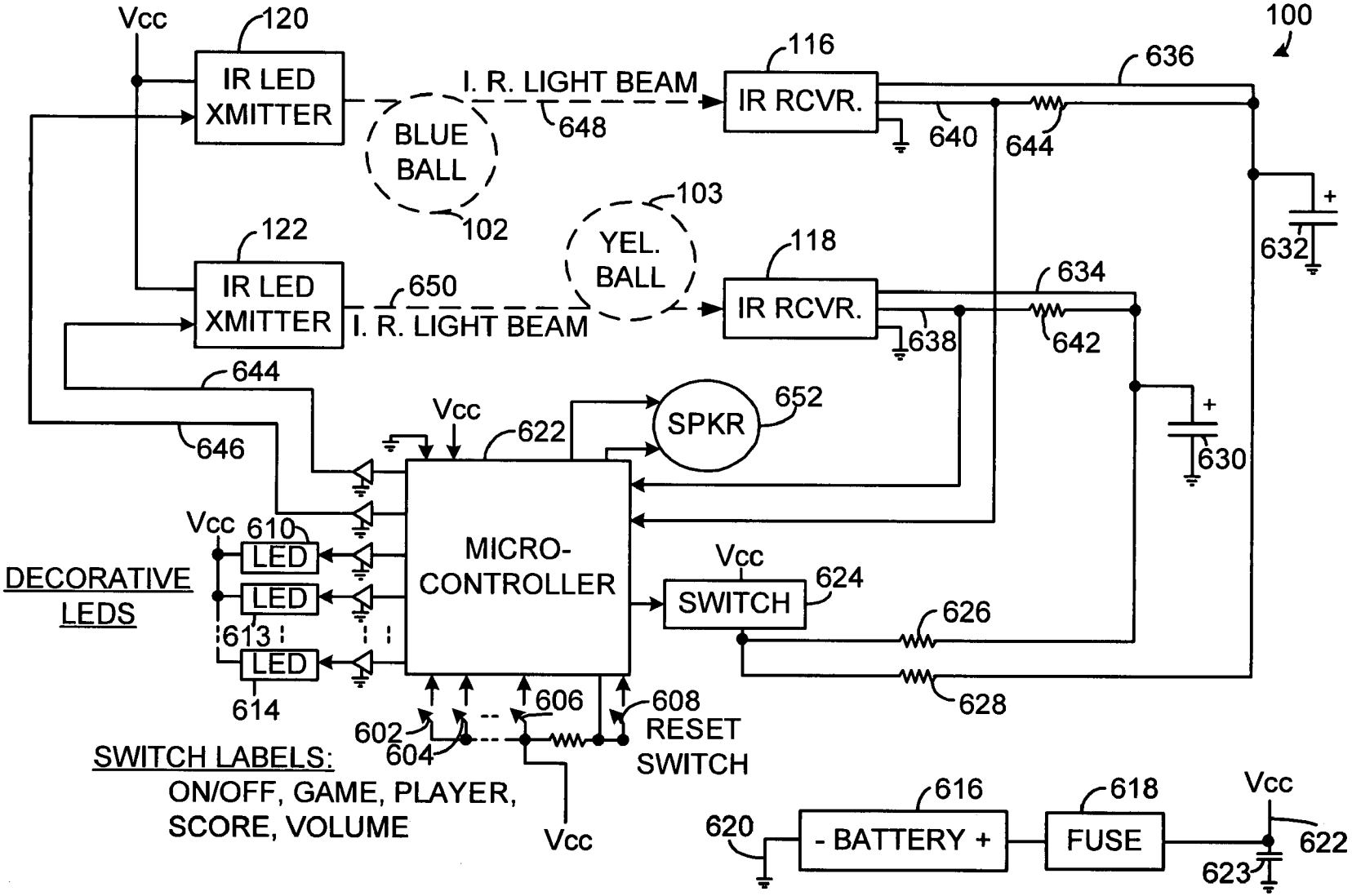
FIG. 6 is a schematic circuit diagram of an embodiment of a bounce ball game illustrating one way in which a microcontroller can be interconnected with two electromagnetic beam transmitters and two electromagnetic beam receivers to form a ball bounce game.

The bounce game 100 includes one or two balls 102 (FIGS. 1 and 6) and 103 (FIG. 6). It also includes a support formed from three parts: a beam transmitter game unit section 106, a beam receiver game unit section 108, and a foldable connecting arm 104.

The connecting arm 104 forms a semicircle that plugs into the sides of the two game unit sections 106 and 108, holding them spaced apart, with the beam transmitters 120 and 122 and beam receivers 116 and 118 (FIG. 4) kept generally aligned such that the two transmitted beams are parallel, spaced apart, and focused upon the corresponding two beam receivers as shown in the figures. Signal conveying wires 644 and 646 and a wire conveying the positive voltage Vcc 622 (all shown in the FIG. 6 schematic circuit diagram) pass through the connecting arm 104 and electrically connect the two beam transmitters 120 and 122 within the beam transmitter game unit section 108 to a microcontroller 622 within the beam receiver game unit section 106.

Figure 2:
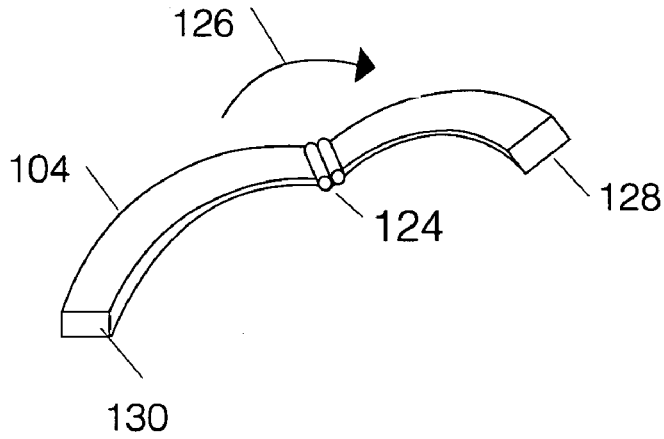
FIG. 2 presents a perspective view of a foldable connecting arm containing connecting wires illustrating how it folds for storage and unfolds for use.
Figure 3:
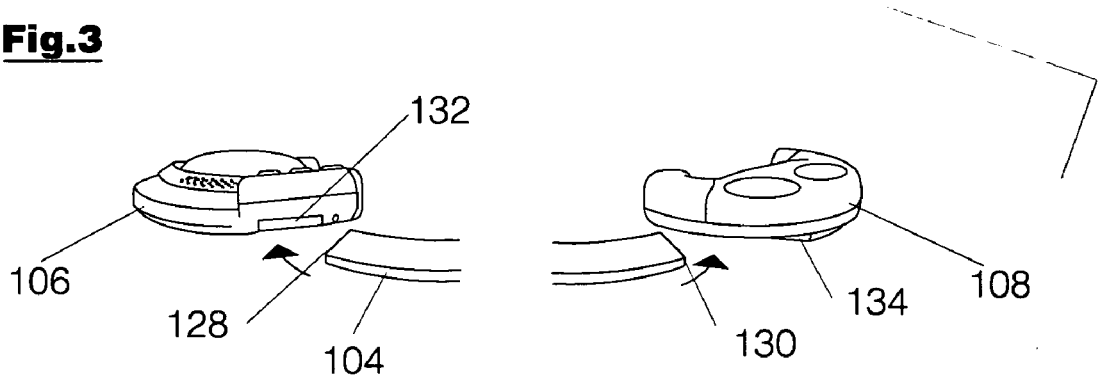
FIG. 3 presents a perspective view of a beam transmitter game unit section, a beam receiver game unit section, and the foldable connecting arm illustrating how the foldable connecting arm is plugged into both game unit sections to connect them together both electrically and mechanically, with the beam transmitters and receivers held in proper beam transmission and reception alignment.

The connecting arm 104 folds about a hinge 124 that is shown in FIG. 2. Two signal wires 644 and 646 and also a wire conveying the positive voltage supply Vcc 622 pass right through this hollow hinge 124. The arm 104 is unfolded into a semicircle for use, as is indicated by an arrow 126. Once unfolded, the two electrical plug ends 128 and 130 of the connecting arm 104 are respectively plugged firmly into matching electrical sockets 132 and 134 in the game unit sections 106 and 108, as is best illustrated in FIG. 3. The ball bounce game 100, when viewed from above, then appears as is shown in FIG. 4.

In an embodiment where the beams are formed of visible light, and particularly in the case of laser light, the beam transmitters 120 and 122 may be arranged to paint a visible line along the surface (not shown) upon which the game rests, thus indicating to the players the paths of the two light beams. An alternative embodiment, illustrated best in FIGS. 1 and 4, provides a pair of retractable strings 110 and 112 that may be pulled out of the game unit section 108 from right beneath each of the beam transmitters 120 and 122 and stretched across and attached, by means of simple eye fasteners such as the eye fastener 114, to tiny hooks (not shown) located on the game unit section 106 just beneath the respective beam receivers 116 and 118, as is illustrated by the arrows 136 and 138 shown in FIG. 4. These strings, when extended, are arranged to be touching the surface upon which the game rests so as not to interfere with the bouncing of any balls. These strings may be wound upon spring-loaded take-up spools (not shown) mounted internally within the game unit section 108 such that the two strings rewind immediately into the section 108 (in the manner of window shades) when their respective eyes are disconnected from the tiny hooks and released.

Figure 4:
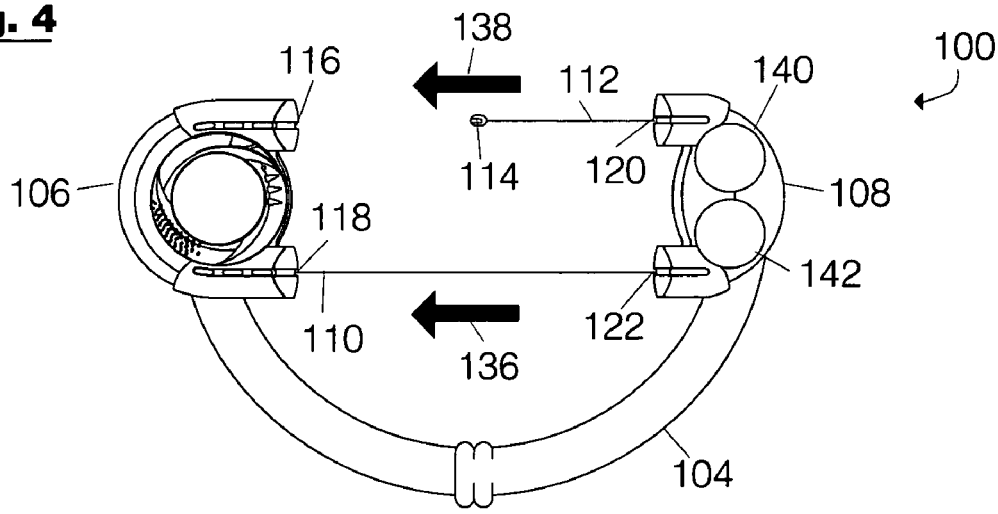
FIG. 4 is a plan view of the two game unit sections connected and spaced apart by the connecting arm illustrating how strings are drawn from one section and connected to the other section to indicate the path of the beam for the benefit of game players.

Spherically-shaped indentations 140 and 142 may be included in the upper surface of one of the one of the game unit sections 108, as is shown in FIG. 4, to form repositories where the two balls 102 and 103 may be stored conveniently between games.

The operation of the bounce gall game is controlled by means of six simple pushbutton switches 602, 603, 604, 605, 606, and 608 that are formed in a semicircular arrangement (FIG. 5) in the upper surface of the beam receiving game unit section 106. The circuitry for four of these switches 602, 603, 606, and 608 is illustratively shown in the circuit diagram presented in FIG. 6, and the remaining two pushbutton switches 604 and 605 (not shown in FIG. 6) are wired in essentially the same manner as the switches 602, 603, and 606. Five of these pushbutton switches 602 to 606 are clearly labeled as indicated below, and these five switches are used during normal game play:

ON/OFF switch 606—Closing this switch by pushing it and releasing it starts the game; closing it again by pushing it and releasing it stops the game. The game also turns off automatically after a three-minute delay during which no player actions are detected by any of the switches 602—608 or by the beam receivers 116 and 118.

GAME switch 604—Three different games are provided in one embodiment: Show Down, Time Challenge, and Point Lead. Each time this switch is depressed (closed) and released (opened), a different one of the three games is selected. To change games in the middle of a game, this switch must be kept depressed (closed) for three seconds.

PLAYER switch 603—Each game may include one, two, or four players. Each time this switch is depressed (closed) and released (opened), the number of players changes.

SCORE switch 602—Depression (closure) and release (opening) of this switch reports the score for the game just completed (however, a score of zero is not reported). The highest score ever achieved for this game is also announced. Holding this switch depressed (closed) for four seconds resets the current game's highest score.

SOUND switch 605—Depression (closure) and release (opening) of this switch adjusts the volume of the speaker. The three possible settings are normal volume, low volume, and off.

The above five switches are implemented as is illustrated by the three switches 602, 603, and 606 shown in FIG. 6. A sixth switch shown in FIG. 6 is a RESET switch 608, and it is wired in a slightly different fashion, as is shown in FIG. 6:

RESET switch 608—Actuating (closing) the switch 608 with a ball point pen resets the microprocessor, and this can clear up problems that may be encountered where the system malfunctions or the microcontroller enters a "hung" state (due to gamma rays or radio-frequency transients that may have altered the state of the microcontroller's RAM memory or register contents or the like).

After the ON/OFF switch 606 is actuated to start a game and the GAME and PLAYER switches 604 and 603 have been (optionally) actuated to select a game and the number of players, a voice generating program within the microprocessor generates a speech message, optionally with music, explaining the rules of the selected game and inviting the player(s) to bounce a ball in such a manner as to block an electromagnetic beam so as to signal that it is time for the selected game to start. When a first ball bounce is detected, the voice may say: "READY! . . . GO!", and then the game begins.

Figure 5:
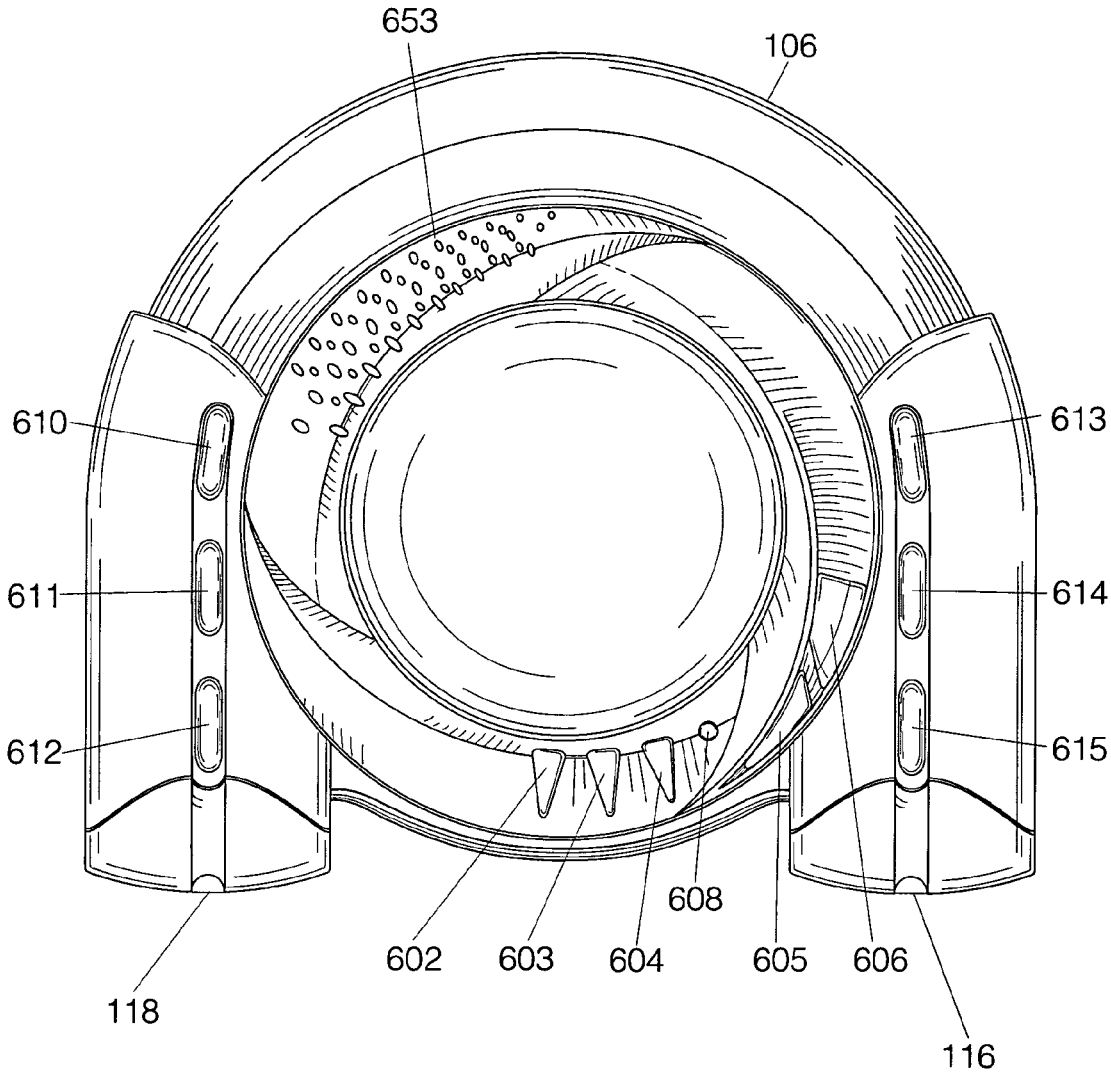
FIG. 5 is a plan view of the beam receiver game unit section illustrating the arrangement of LED lights and pushbutton switches.

To enhance the game, colored light emitting diodes, such as the six red LED lights 610, 611, 612, 613, 614, and 615 shown in FIG. 5 (three of which lights 610, 611, and 615 are also shown illustratively in the circuit diagram of FIG. 6) may be embedded into the upper surface of one or both of the game unit sections 106 (FIG. 5) or 108 (not shown). In the embodiment shown in FIG. 5, two sets of these three LED lights 610, 611, and 612 (first set) and also 613, 614, and 615 (second set) are embedded into the upper surface of the beam receiver game unit section 106. One of these sets of lights positioned adjacent each of the two beam receivers 116 and 118 to signal that the adjacent beam is operational and should be targeted by the player. The three LED lights in the set adjacent each beam receiver are shown in FIG. 5 positioned to form a line just above and parallel to the centerline of the adjoining beam so as to indicate to the players (along with the strings shown in FIG. 4) just where the invisible infrared beam is located. In the case of a one-player game, these LED lights 610–615 can be used to signal which of the two beams a single game player must block (by bouncing the ball in the path of the beam) during that player's next turn. In one game (described below), play shifts randomly from one beam to the other, as is indicated by these sets of LED lights 610–612 and 613–615, and the single player is penalized if the ball chances to block the wrong beam. So these LED lights can add considerable excitement to some games.

Circuit Details

FIG. 6 presents a schematic circuit diagram of the ball bounce game 100, showing its internal electrical and electronic parts. None of the supporting structure is shown in FIG. 6.

With reference to FIG. 6, the game 100 is powered by a 4.5 volt battery 616, which may be three M cells, either regular or rechargeable. The battery 616 is connected in series with a fuse 618, which may also be a diode to protect against damage caused by battery reversal. The battery 616 and fuse 618 are hooked serially from ground 620 to Vcc 622, the positive supply for the game 100.

The game 100 contains a microcontroller 622 complete with internal RAM and ROM memory. The microcontroller 622 normally rests in a "shut-down" mode, in which it draws almost no current. When the ON/OFF switch 606 is momentarily closed, internal hardware (not shown) within the microcontroller 622 powers it up and commences program execution. When the switch 606 is depressed again, or after 3 minutes with no input from any of the switches 602–606 and 608 or either beam receiver 116 and 118, the microprocessor 622 shuts down again, preserving only the best score values internally.

The infrared sensor beam receivers 116 and 118 are normally powered off by means of a transistor switch 624. When the beam receivers 116 and 118 are to be read, the microcontroller 622 turns on the electronic switch 624 and thereby permits current to flow from Vcc through the two filter resistors 626 and 628 into two filter electrolytic capacitors 630 and 632 which respectively provide carefully filtered control voltages 634 and 636 to each of the beam receivers 116 and 118, as shown in FIG. 6. The filter resistors and capacitors provide isolation of the receivers 116 and 118 from each other, from power supply voltage transients, and from spurious radio frequency signals generated by the microprocessor 622.

The microcontroller 622 is powered by current drawn from Vcc 622 and ground 620, filtered for spurious radio frequency signals by a ceramic capacitor 623. The microcontroller 622 generates binary (on/off) output signals on the two signal lines or wires 644 and 646. These signals are applied to the beam transmitters 120 and 122 which in this embodiment are infrared light emitting diode (or LED) transmitters. The beam transmitter 120 develops an infrared (invisible) light beam 648 which reaches the infrared receiver 116 unless it is blocked, for example, by the blue ball 102, as shown. Likewise, the beam transmitter 122 develops an infrared (invisible) light beam 650 which reaches the infrared receiver 118 unless it is blocked, for example, by the yellow ball 103, as shown.

In response to incoming infrared and other light, the beam receivers 116 and 118 develop output signals on signal lines 638 and 640 and across the two resistors 642 and 644. These output signals are fed into the microcontroller 622 where they are analyzed to see if one or both beams are being received from one or both transmitters or whether one or both of the bouncing balls are blocking one or both of the beams of infra-red light.

To distinguish the infrared beam transmissions from other light that may be present in the vicinity of the game 100, the microcontroller 622 can apply a distinctive signal or encoding or modulation (in the form of a distinctive signal on/off sequence) to both beam transmissions, analogous to those used with television remote control infrared signals. If the incoming signal received by one of the beam receivers 116 or 118 contains the distinctive signal or modulation or encoding that is being applied to its corresponding beam transmitter 120 or 122, then the beam signal is getting through and is not being blocked by the game ball. If the incoming signal does not contain that distinctive signal or modulation or encoding, then the beam is presumed to be blocked by one of the game balls. Alternatively, the electromagnetic beams may be made directional enough, through directional beam design in the transmitters or receivers or both, such that a distinctive signal, modulation, or encoding is not essential. Or both directionality in the beam transmitters and receivers and a distinctive signal or modulation or encoding may be used together to eliminate crosstalk between the two beams and to minimize interference caused by other sources of electromagnetic radiation, such as sunlight or room light or infrared light from other sources.

The speaker 652 (shown in FIG. 6 and hidden beneath sound holes 653 penetrating the top of the beam receiver game unit section 106 shown in FIG. 5) is driven directly by an output of the microcontroller 622 with voice and music signals and other audio special effects signals as desired to add to the fun of playing the game.

Description of the Individual Games

An embodiment of the game 100 comes equipped to play three different games with one, two, or four players.

A first game called SHOW DOWN measures how long it takes the best player to bounce the ball so that it blocks that player's beam 20 times. In the one-player game, the player receives one point each time the beam signaled by illumination of the LED lights 610–612 or 613–615 (FIG. 5) aligned parallel to and above that beam 648 or 650 (FIG. 6) is broken by the bouncing ball 102 (or 103). The player preferably places the game close to a wall so that the ball bounces on the floor or table to block the beam and then bounces off the wall and back to the player each time after it is tossed. A point is subtracted if the other beam (whose LED lights are not illuminated) is broken. In the two-player version of this game, the two players preferably stand on opposite sides of the game and bounce the ball back and forth between them, each player aiming for only that player's one of the two beams. In the four-player version, the players pair up, and one player in each pair stands on the opposite side of the game from the other player in each pair, such that two opposing players are on opposite sides of the game. The players in each pair bounce their ball back and forth and aim for their particular beam as rapidly and as accurately as they can.

A second game is TIME CHALLANGE. This game measures how many points can be scored in 45 seconds. With one player, the game is preferably placed against a wall, as in the case of the first game with one player. The LED lights again signal which beam the player should aim for each time. Each time the player hits a beam, the LED lights adjacent that beam are turned off, the LED lights adjacent the other beam are turned on, and now the player must block the other beam. The player is penalized one point for hitting the wrong beam. The two-player version of this game has the two players standing on opposite sides of the game, as in the first game, batting a single ball back and forth, and each aiming at only one beam. The game ends in 45 seconds, and the highest scoring player wins. The four-player version of this game is similar to the four-player version of the first game, but the team that blocks its beam the most times in 45 seconds wins.

A third game is POINT LEAD. The goal is to score as many points as possible, and the game ends (in the two-player version) when one player leads the other by 5 points. In the one-player version of this game, the game is placed next to a wall as described above. The illuminated LED lights indicate which beam the player must hit each time. The beam changes randomly—there is no regular pattern as to which beam the player must hit next. The game ends when the player hits the wrong beam five times. Each such wrong beam hit costs the player a point. The two- and four-player games are like the two- and four-player versions of the other games, but the game ends when one player, or one team, is five points ahead.

All the games provide bonus points for speed. If a light beam is hit twice within two seconds by a player or a team, a bonus point is awarded.

While several embodiments of the invention have been described, further modifications and changes will occur to those skilled in the art. Accordingly, the claims appended to and forming a part of this specification are intended to cover all such modifications and changes as fall within the true spirit and scope of the invention.

What is claimed is:

1. A game device for use with objects and a generally planar surface, comprising:

at least two electromagnetic beam transmitters arranged to emit electromagnetic beams and at least two corresponding electromagnetic beam receivers generating signals;

a support for the transmitters and receivers having a surface shaped to rest stably against the planar surface, the support positioning each transmitter to emit its electromagnetic beam parallel to the other beams and parallel to the planar surface, the support positioning each receiver to receive one of the electromagnetic beams, and the support shaped to permit the objects to pass through the beams and to strike the planar surface without striking the support; and a game computer arranged to receive signals from the receivers and programmed to implement at least one game where performance is judged by analysis of the signals received from the receivers.

2. A game in accordance with claim 1 wherein:

the beam transmitters are infrared light emitting diodes and the receivers are infrared receivers.

3. A game in accordance with claim 1 wherein:

the game computer causes the beam transmitters to generate beams modulated or encoded with unique signals, and the game computer demodulates or decodes the signals produced by the beam receivers to determine the presence or absence of the unique signals in the received beam signals.

4. A game in accordance with claim 1 which further includes:

a speaker connected to the game computer and programs within the game computer that generate sound signals and present the sound signals to the speaker.

5. A game in accordance with claim 4 wherein the programs that generate sound include programming steps for generating intelligible speech.

6. A game in accordance with claim 5 wherein the programming steps that generate intelligible speech are able to report scoring of the game.

7. A game in accordance with claim 5 wherein the programming steps that generate intelligible speech are able to instruct players on how to play the game and also report the progress and score of the game.

8. A game in accordance with claim 1 wherein the support comprises:

a transmitter game unit section containing the beam transmitters;

a receiver game unit section containing the beam receivers;

a connecting arm detachably connecting the two game units together positioned to align the transmitters and receivers; and the game computer is a microcontroller residing within one of the two game unit sections.

9. A game in accordance with claim 8 wherein one of the game unit sections contains retractable strings or ribbons that may be stretched to and connected to the other game unit section to indicate to the players the path of the beams.

10. A game in accordance with claim 8 wherein the connecting arm contains signal wires that convey signals between the beam transmitters or beam receivers in one game unit section and the game computer in the other game unit section.

11. A game in accordance with claim 8 wherein the connecting arm is semicircular in shape.

12. A game in accordance with claim 8 wherein the connecting arm includes a hinge that permits it to be folded for convenient storage.

13. A game in accordance with claim 8 wherein at least one of the game unit sections contains on its upper surface illuminable light emitting devices aligned with each of the beams and selectively illuminable by the game computer.

14. A game playing method wherein one or more game players bounce a ball against a surface comprising:

projecting at least two electromagnetic, energy-conveying beams generally parallel to each other and generally parallel to and adjacent the surface, positioning the beams such that it is possible for a game player to bounce the ball against the surface in such a manner as to cause the ball to pass through one of the beams;

detecting the energy conveyed by the electromagnetic beams from a position beyond where the ball may normally pass through a beam;

signaling the cessation of beam energy detection whenever the ball passes through one of the beams; and responding to such signaling by computing from such signaling performance scores for the one or more game players.

15. A game playing method in accordance with claim 14 wherein the electromagnetic energy-conveying beams convey infrared energy, such that the beams are invisible.

16. A game playing method in accordance with claim 15 and further comprising presenting a visible indication of the beam paths to the game players.

17. A game playing method in accordance with claim 14 wherein the electromagnetic beams are modulated or encoded with unique signals, and the detecting step includes demodulating or decoding these signals to determine the presence or absence of the unique signals, the absence of the unique signals being an indication of the cessation of beam energy.

18. A game playing method in accordance with claim 14 further comprising generating audio signals indicative of the game performance scores of the one or more game players.

19. A game playing method in accordance with claim 18 wherein the generated audio signals include intelligible speech.

20. A game playing method in accordance with claim 19 wherein the intelligible speech instructs the one or more players how to play the game in addition to indicating the game performance scores.

* * * * *